United States Patent [19]

Preston

[11] 4,270,796

[45] Jun. 2, 1981

[54] RECLINING CHAIR WITH LEG REST OPERATING MECHANISM

[76] Inventor: William B. Preston, 3620 Stewart Rd., Monroe, Mich. 48161

[21] Appl. No.: 47,714

[22] Filed: Jun. 12, 1979

[51] Int. Cl.[3] ..... A47C 1/02

[52] U.S. Cl. ..... 297/69; 297/84; 297/342

[58] Field of Search ..... 297/69, DIG. 7, 90, 297/342, 321, 320, 88, 83, 84, 85, 89

[56] References Cited

U.S. PATENT DOCUMENTS

| | | | |
|---|---|---|---|
| 3,099,487 | 7/1963 | Knabusch et al. | 297/DIG. 7 |
| 3,325,210 | 6/1967 | Knabusch et al. | 297/69 X |
| 3,357,739 | 12/1967 | Knabusch et al. | 297/69 |
| 3,743,349 | 7/1973 | Crum et al. | 297/69 X |
| 4,025,113 | 5/1977 | Rogers, Jr. | 297/DIG. 7 |
| 4,071,276 | 1/1978 | Cecil | 297/DIG. 7 |

*Primary Examiner*—James T. McCall
*Attorney, Agent, or Firm*—R. C. Ruppin

[57] ABSTRACT

A leg rest operating mechanism for a recliner chair is disclosed in which the leg rest and the leg rest actuating means are mounted on the movable chair seat. A manually operable drive means is mounted on the chair frame and a linkage type lost motion means connects the drive means and the actuating means. The lost motion means permits the seat and leg rest to move relative to the chair frame and drive means without affecting the ability of the drive means and actuating means to extend or retract the leg rest.

10 Claims, 4 Drawing Figures

RECLINING CHAIR WITH LEG REST OPERATING MECHANISM

BACKGROUND OF THE INVENTION

This invention relates to movable leg rests for recliner chairs and in particular to a leg rest actuating mechanism for a recliner chair in which the chair seat carries the leg rest and is movable relative to the frame of the chair.

Movable leg rests for recliner chairs are well-known in the prior art. A movable leg rest for a recliner chair may be automatically actuated in response to chair movement or may be handle actuated between an extended or use position, and a retracted or storage position. In the extended position, the leg rest is disposed generally horizontal to floor level in front of the front edge of the chair. In the retracted position, the leg rest is generally disposed in a vertical position, and is usually retracted up against the front edge of the chair beneath the seat. With the leg rest in the extended attitude, a user may lean back or recline in the chair and place his legs on the leg rest, thereby orienting the legs in an outstretched or generally horizontal position. With the leg rest in the retracted attitude, the user sits in the chair normally with his feet on the floor, thereby permitting the chair to be used in the usual fashion since the leg rest is retracted up against the chair behind the chair user's legs.

One common type of leg rest is a type that is supported on the frame of the chair. This type of leg rest is typically actuated by a pantographing linkage type of mechanism between its retracted and extended positions. This type of mechanism includes several linkages which are connected together in scissors fashion to move the foot rest from its relatively vertical position when retracted to a horizontal position when extended and to hold the foot rest in the horizontal attitude. This type of actuating mechanism is usually quite complicated, in part because of the requirement that the linkages not only extend the leg rest but that they also move the leg rest from a vertical to a horizontal position. Another type of leg rest is one that is supported by the chair seat rather than the frame of the chair. The advantage of this arrangement is that the leg rest and seat relationship stay the same through all positions of the seat. However, this type of leg rest also generally uses the complicated pantographing actuating mechanism to extend and retract the leg rest. Further, the actuating mechanism in this type of seat and leg rest arrangement is complicated by the need in many cases to mount the drive means for the actuating mechanism on the chair frame so that the drive means does not move and interfere with other parts of the chair such as the upholstery, legs and frame members. The need to provide a connection between the drive means and the actuating mechanism which permits movement of the actuating mechanism with the seat adds further complexity to the leg rest actuating mechanism.

The closest prior art references of which the applicant is aware are U.S. Pat. No. 3,357,739 to Knabusch and U.S. Pat. No. 3,863,980 to Ciner. Copies of each of these patents are enclosed with this patent application.

A recliner chair is disclosed in the Knabusch U.S. Pat. No. 3,357,739 in which a leg rest is carried by a seat and the seat and leg rest are movable together relative to the base frame of the chair. A leg rest actuating means of the pantographing type is also supported on the seat and is movable with the seat. A drive means is mounted on the base frame and remains stationary relative to the seat. To permit the drive means to provide operating force to the actuating mechanism at any position of the seat throughout its range of movement, a universal drive shaft connects the drive means and the actuating means. In contrast, the invention herein disclosed utilizes a simple linkage driven by a drive shaft to actuate the leg rest. Further, the "lost motion" required to permit movement of the seat and leg rest relative to the drive means is accomplished in the invention by movement of the linkages in the same manner as they are moved to operate the leg rest about axes which are parallel to each other as opposed to the more complicated arrangement of the Knabusch patent.

In the Ciner U.S. Pat. No. 3,863,980, there is disclosed a chair having a reclining back and a seat which moves forwardly as the back reclines. A leg rest is pivotally mounted on the end of the seat and is extended or retracted by a rack and gear type of actuating means which is carried by and moves with the seat. The gear type actuating means is relatively complicated and the drive means for the actuating means is mounted with the actuating means on the seat. Although a link connected to the rack pivots the leg rest on the end of the seat between extended and retracted positions, the rack and gear are key elements of the actuating means and this is a significantly different type of mechanism than that disclosed herein.

SUMMARY OF THE INVENTION

The objects of the invention include the provision of a simple and effective actuating mechanism for the leg rest of a recliner chair having a leg rest mounted on the seat of the chair and the drive source for the actuating means mounted on the frame of the chair.

A further objective of the invention is the provision of an improved and simplified lost motion linkage means which permits movement of the seat and actuating means relative to a stationary drive source without affecting the ability of the drive source to provide operating force to the actuating means in any position of the seat.

The objects of the invention also include the provision of an operating linkage assembly for a leg rest mounted on a movable seat of a recliner chair in which all pivotable elements of the operating mechanism pivot about axes which are parallel.

In general, the objects of the invention are accomplished by the provision of simplified linkage type actuating mechanism for the leg rest of a recliner chair. The actuating mechanism includes a lost motion means comprising two linkages, one of which is affixed to the drive shaft of the drive means, and which are movable between a collapsed and extended position as the seat moves relative to the frame of the chair. By utilizing movement of the linkages to accommodate the changing position of the chair seat relative to the chair frame, the actuating means will not be limited in its response to the drive means to extend or retract the leg rest.

BRIEF DESCRIPTION OF THE DRAWINGS

The aforegoing and other objects and features of the present invention will be more clearly understood from the following detailed description thereof when read in conjunction with the accompanying drawings, in which.

DESCRIPTION OF THE PREFERRED EMBODIMENT

Figure 1:
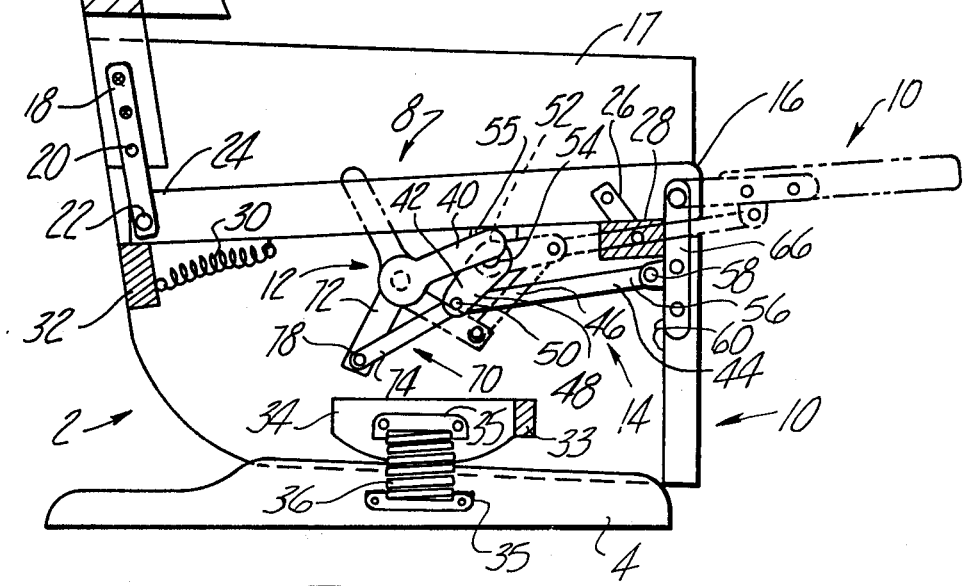
FIG. 1 is a cross-sectional elevation view of a recliner chair according to the invention with the chair back in an upright position and the leg rest shown in a retracted position in full lines and in an extended position in phantom lines.
Figures 2, 4:
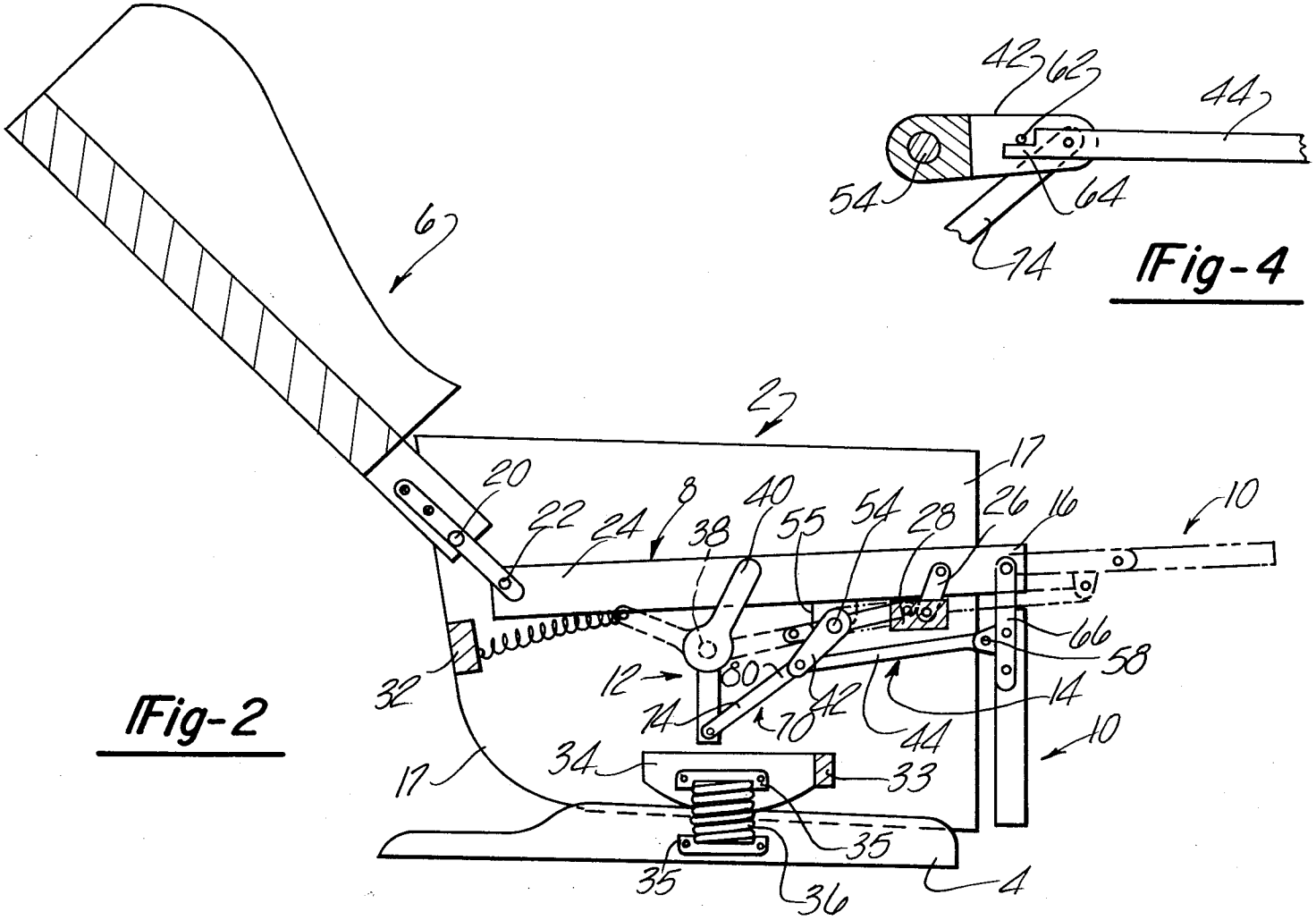
FIG. 2 is a cross-sectional elevation view of the recliner chair of FIG. 1 with the chair back in a reclined position and the leg rest shown in a retracted position in full lines and in an extended position in phantom lines.
FIG. 4 is an enlarged broken-away view of part of the leg rest actuating mechanism of the chair shown in FIGS. 1 and 2.

Referring to FIGS. 1 and 2 of the drawings, there is shown a recliner chair having a frame 2 supported on legs 4, a back 6 and a seat 8. The frame 2 includes cross members 32 and 33 and side boards 17. A leg rest 10 is pivotally connected to the front end 16 of the seat 8 by straps 66. A driving means 12 is mounted on the frame 2 and provides operating force to cause an actuating or linkage means 14 supported on the seat 8 and connected to the leg rest 10 to move the leg rest 10 between its retracted position shown in full lines in FIGS. 1 and 2 and its extended, relatively horizontal position shown in phantom lines in FIGS. 1 and 2.

The chair back 6 has a pair of metal straps 18 affixed to it and pivotally pinned to side boards 17 of frame 2 at pivot point 20. Thus, the back 6 is mounted on the frame 2 and can be pivoted between an upright sitting position and a reclined position relative to the frame 2. The straps 18 are also pivotally pinned at points 22 to back end 24 of the chair seat 8. The front end 16 of the seat 8 is movably connected to the frame 2 by means of links 26 which are pivotally pinned to the seat 8 and shoulder members 28 of frame 2. A pair of springs 30 are connected to the seat 8 adjacent its back end 24 and to the cross member 32 of frame 2. The springs 30 apply biasing force to the seat 8 to hold the back 6 in an upright position and the seat 8 in its rearward position as shown in FIG. 1. When a person is seated in the chair in its position as shown in FIG. 1, pressure applied by the person against the chair back 6 will cause the back 6 to pivot in a reclining direction about the frame 2 at pivot point 20 and thereby cause the seat 8 to move forward in a relatively horizontal direction with the back 6 due to the force applied to the seat 8 by the back 6 via the straps 18. The back 6 and seat 8 may thus be made to assume their respective reclined and forward positions as shown in FIG. 2. In these latter positions, the springs 30 urge the back 6 and seat 8 to return to their respective upright and rearward positions as shown in FIG. 1, however, as long as pressure sufficient to overcome the spring bias is applied to the back 6 or to the seat 8 by a person on the chair, the back 6 and seat 8 will stay in their positions as shown in FIG. 2.

The frame 2 includes a pair of rocker members 34 attached to side boards 17 and which bear against and may be rocked on on the upper surfaces of the legs 4. A pair of springs 36 are attached to the frame 2 and legs 4 by rackets 35 and hold the rocker members 34 against the legs 4 and also provide a resilient force to return the chair to its relatively upright position as shown in FIGS. 1 and 2 after each rocking movement of the chair either in a clockwise or counterclockwise direction.

Figure 3:
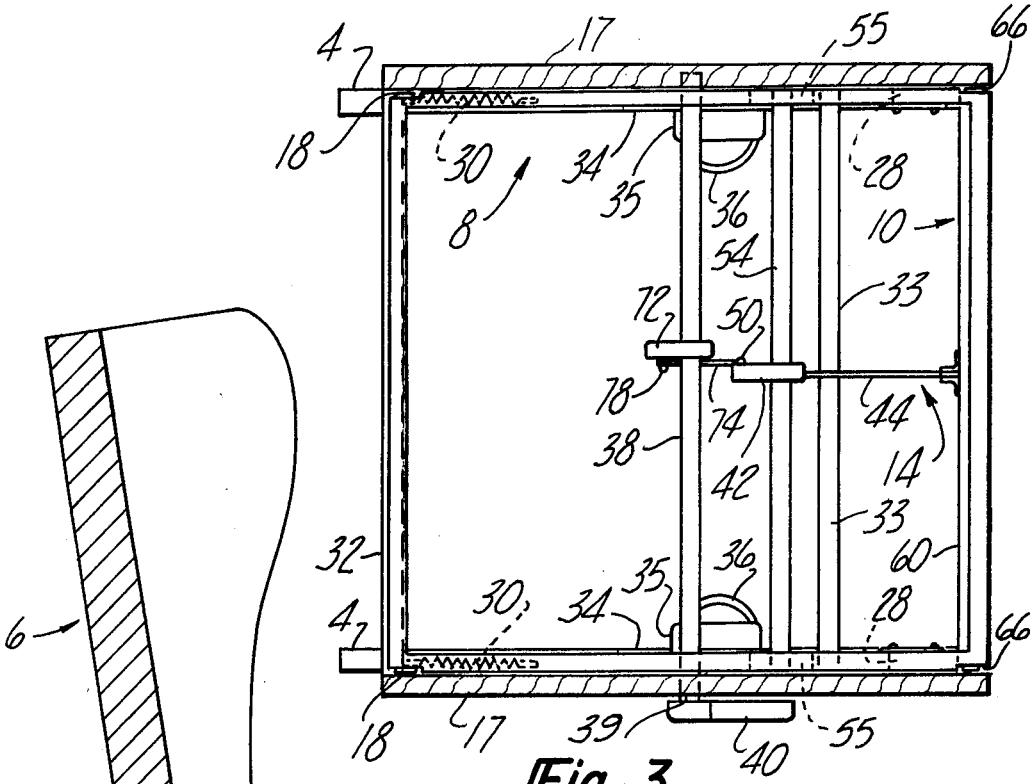
FIG. 3 is a plan view, partially in cross-section, showing the frame, seat and leg rest actuating mechanism of the chair illustrated in FIGS. 1 and 2.

As previously stated, the drive means 12 is mounted on frame 2. The drive means 12 thus remains in a fixed position relative to the seat 8 which is movable relative to the frame 2 and carries with it the leg rest 10 and linkage means 14 for actuating the leg rest 10. The shaft 38 of drive means 12 is rotatably supported on the side boards 17 and extends transversely of the seat 8, as shown in FIG. 3. The drive shaft 38 extends through one of the side boards 17 and any upholstery that covers the chair to the outside of the chair, and has a manually operable handle 40 rigidly affixed to it as is shown in FIGS. 1, 2 and 3.

The actuating linkage means 14 includes a bifurcated link 42 and a link 44 which respectively have ends 46 and 48 pivotally pinned together at point 50. The other end 56 of the link 44 is pivotally pinned at point 58 directly to the bottom 60 of the leg rest 10. The other end 52 of link 42 is mounted to pivot freely on shaft 54. Shaft 54 is rigidly affixed to supports 55 on the bottom of seat 8. When the drive means 12 is operated to turn the shaft 38 in a counterclockwise direction, the links 42 and 44 are moved from their position as shown in full lines in FIG. 1 to their extended position as shown in phantom lines. The leg rest 10 is thereby moved from its retracted position as shown in full lines in FIG. 1 to its extended position as is shown in phantom lines. With reference to FIG. 4, the leg rest 10 is held in its extended position by an overcenter toggle lock which utilizes a pin 62 bridging the bifurcation of link 42 and a finger 64 which is an extension of the end 46 of link 44. When the links 42 and 44 are driven to a position such that the knee formed by their pivotally connected ends 46 and 48 is slightly above center relative to the view of FIG. 4, they will lock to create a rigid supporting force for the leg rest 10 until such time as the pivotally connected ends 46 and 48 are moved downward by clockwise rotation of drive shaft 38.

The actuating linkage means 14 also includes lost motion linkage means 70 comprising a first link 72 rigidly affixed to the drive shaft 38 and a second link 74 having an end 76 pivotally pinned to the link 72 at pivot point 78. The other end 80 of link 74 is pivotally pinned to the links 42 and 44 at pivot point 50. When the drive shaft 38 is rotated by manual rotation of the handle 40, the link 72 applies force to the links 74, 42 and 44 to move the leg rest 10 to its extended position or retracted position, depending on the direction of rotation of the handle 40 and drive shaft 38.

As previously indicated, the links 72 and 74 function to provide lost motion in that when the seat 8 is moved relative to the frame 2 between its rearward and forward positions, the links 72 and 74 will move between a collapsed position and a relatively extended position, however, the links 72 and 74 will not actuate the leg rest 10 and so their motion is lost insofar as the leg rest 10 is concerned. If the leg rest 10 is in its retracted position as shown in full lines in FIGS. 1 and 2, and the seat 8 is moved between its rearward and forward positions, the links 72 and 74 will move between the fully collapsed position shown in full lines in FIG. 1 and the partially collapsed position shown in full lines in FIG. 2. If the leg rest 10 is in its extended position as shown in phantom lines in FIGS. 1 and 2, movement of the seat 8 between its rearward and forward positions will cause the links 72 and 74 to move between the partially extended position as shown in phantom lines in FIG. 1 and the fully extended position as shown in phantom lines in FIG. 2. During the movement of the links 72 and 74 between their positions as shown in FIGS. 1 and 2 in response to movement of the seat 8, the handle 40 and drive shaft 38 will rotate to the extent necessary for the links 72 and 74 to extend or retract, however, the links 42 and 44 will not move, but will retain their position in which the leg rest 10 is either retracted or extended. Thus, neither the links 42 and 44 or the links 72 and 74 will prevent movement of the seat 8. Similarly, the seat 8 will not prevent extension of the leg rest 10 by the links 72, 74, 42 and 44, regardless of the position of the seat 8.

It should be noted that the movement of the links 72 and 74 between collapsed and extended positions and positions intermediate thereof is the same irrespective of the motivating source for such movement. The sources, of course, are the movement of the drive means 12 to extend or retract the leg rest 10, or the movement of the seat 8 with back 6 between its forward and rearward positions. It should be appreciated that this dual function of the same movement or mode of operation of the links 72 and 74 is of important significance in obtaining the objective of a simple yet effective leg rest operating mechanism.

It should also be appreciated that the provision of a drive means and a lost motion means having pivotable or rotatable elements all of which rotate about axes parallel to each other contributes to a simple but effective mechanism. In addition, the use of a final drive link which is part of an overcenter toggle lock and that is connected directly to a leg rest pivoted on the seat also contributes to the effectiveness and simplicity of the leg rest operating mechanism.

It will be understood that the foregoing description of the preferred embodiment of the present invention is for purposes of illustration only, and that the various structural and operational features herein disclosed are susceptible to a number of modifications and changes, none of which entail any departure from the spirit and scope of the present invention as defined in the hereto appended claims.

What is claimed is:

1. In a reclining chair having a frame, a chair back pivotally mounted on the frame for movement from an upright sitting position to a reclining position, a chair seat supported by the frame and having a rear end pivotally interconnected with the back, whereby the seat moves substantially horizontally relative to the frame with the back as the latter moves between its positions, the improvement comprising:

a leg rest pivotally connected to the front end of the seat;

linkage means supported by and movable with said seat and connected to said leg rest for moving the leg rest between a retracted position and an extended, horizontal position;

drive means mounted on said frame and connected to the linkage means for actuating the linkage means to move the leg rest; and lost motion means comprising part of the linkage means and connected to the drive means for permitting movement of the seat relative to the frame independently of the functioning of the drive means and the position of the leg rest.

2. The combination according to claim 1 wherein said lost motion means includes a plurality of links movable substantially in the direction of movement of the chair seat.

3. The combination according to claim 2 wherein the plurality of links are pinned together and have a collapsed position when the chair back is in an upright sitting position and the leg rest is in a retracted position and an extended position when the chair back is in a reclining position and the leg rest is in a retracted position.

4. In a reclining chair having a frame, a chair back pivotally mounted on the frame for movement from an upright sitting position to a reclining position, a chair seat supported by the frame and having a rear end pivotally interconnected with the back, whereby the seat moves substantially horizontally relative to the frame with the back as the latter moves between its positions, the improvement comprising:

a leg rest pivotally connected to the front end of the seat;

drive means mounted on said frame;

actuating means supported by and movable with said seat, said actuating means being connected to the drive means and the leg rest for receiving driving force from said drive means and transferring such driving force to the leg rest to move the leg rest between an extended horizontal position and a retracted position below the seat in response to operation of the drive means; and said actuating means includes linkage means having a first movement in response to movement of the drive means to transfer said driving force to the actuating means, and a second movement in response to movement of the chair seat for maintaining an effective operating connection between the actuating means and the drive means, said first and second movements being identical.

5. In a reclining chair having a frame, a chair back pivotally mounted on the frame for movement from an upright sitting position to a reclining position, a chair seat supported by the frame and having a rear end pivotally interconnected with the back, whereby the seat moves substantially horizontally relative to the frame with the back as the latter moves between its positions, the improvement comprising:

a movable leg rest pivotally connected to the front end of the seat;

linkage means supported by and movable with said seat and connected to said leg rest for moving the leg rest between an extended, horizontal position and a retracted position below the seat;

drive means having a drive shaft rotatable about a longitudinal axis and mounted on said frame for providing actuating force for moving the leg rest; and lost motion means pivotable only about axes which are parallel to the axis of the drive shaft, said lost motion means being connected to the drive means and to the linkage means for transferring actuating force from the drive means to the linkage means and for permitting movement of the seat relative to the frame independently of the functioning of the of the drive means and the position of the leg rest.

6. The combination according to claim 5 wherein the linkage means includes a pair of links pinned together and having a locked position for holding the leg rest in its extended horizontal position, one of said links being connected to the leg rest for transmitting force from the drive means to the leg rest.

7. The combination according to claim 6 wherein the other of said links comprises part of the lost motion means.

8. The combination according to claim 7 wherein said other link is pivotable only about axes which are parallel to the axis of the drive shaft.

9. The combination according to claim 1 wherein the lost motion means is effective to move the leg rest between said retracted and horizontal positions.

10. In a reclining chair having a frame, a chair back pivotally mounted on the frame for movement from an upright sitting position to a reclining position, a chair seat supported by the frame and having a rear end pivotally interconnected with the back, whereby the seat moves substantially horizontally relative to the frame with the back as the latter moves between its positions, the improvement comprising:

a leg rest pivotally connected to the front end of the seat;

linkage means supported by and movable with said seat and connected to said leg rest for moving the leg rest between a retracted position and an extended, horizontal position;

drive means mounted on said frame and including a rotatable drive shaft, said drive means being connected to the linkage means for actuating the linkage means to move the leg rest; and lost motion means comprising part of the linkage means and connected to the drive means for permitting movement of the seat relative to the frame independently of the functioning of the drive means and the position of the leg rest, said lost motion means including a first link rigidly affixed to the drive shaft and a second length pivotly pinned to the first link, said first link being rotatably movable with the drive shaft in the direction of the chair seat movement in response to movement of the second link with the chair seat whereby movement of the chair seat is not constrained by the connection of the drive means to the linkage means.

* * * * *